US006524760B1

(12) United States Patent
Ikeuchi et al.

(10) Patent No.: US 6,524,760 B1
(45) Date of Patent: Feb. 25, 2003

(54) IMAGE RECEIVING SHEET AND RECORDING PROCESS

(75) Inventors: Nobuho Ikeuchi, Tokyo (JP); Masafumi Hayashi, Sayama (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 09/461,341

(22) Filed: Dec. 15, 1999

(30) Foreign Application Priority Data

Dec. 16, 1998 (JP) ..... 10-357299

(51) Int. Cl.[7] ..... G03G 13/00; B41M 5/00

(52) U.S. Cl. ..... 430/41; 428/195; 428/212; 428/409; 430/124

(58) Field of Search ..... 428/195, 913, 428/914, 212, 409; 430/41, 124

(56) References Cited

U.S. PATENT DOCUMENTS 5,258,255 A 11/1993 Shimizu et al. ..... 430/110
5,266,432 A 11/1993 Hayashi et al. ..... 430/109

OTHER PUBLICATIONS

US 5,032,440, 7/1991, Takeuchi et al. (withdrawn)

*Primary Examiner*—Bruce H. Hess
(74) *Attorney, Agent, or Firm*—Morgan, Lewis & Bockius LLP

(57) ABSTRACT

An image receiving sheet includes a substrate and a receptor layer. The substrate has at least one face, the receptor layer has a binder resin, and the receptor layer is provided on the face of the substrate. The binder resin of the receptor layer has storage elasticity moduli of $10^4$ Pa or more at 130° C. and $10^2$ Pa or more at 200° C.

17 Claims, 2 Drawing Sheets

IMAGE RECEIVING SHEET AND RECORDING PROCESS

This application claims the benefit of Japanese Patent Application No. 10-357299, filed in Japan on Dec. 16, 1998, which is hereby incorporated by reference. This application also hereby incorporates by reference U.S. patent application No. 09/429,649 filed Oct. 29, 1999, now U.S. Pat. No. 6,410,199.

BACKGROUND OF THE INVENTION

1. Field of the Invention

The present invention relates to electrophotographic recording of images and, more particularly, to an image receiving sheet and recording process for use in elecrophotographic recording of images.

2. Description of the Related Art

Practical processes for forming full color electrophotographic images using three colors of yellow, magenta and cyan (or four colors including black in addition to the above three colors) have been recently developed. The image receiving sheet used in electrophotography usually comprises a receptor layer formed on a substrate to securely record and hold letters, pictures, and other information. The image receiving sheet is applied to an overhead projector as an information transmission means for use in meetings, schools, companies, and other presentations and exhibitions.

When a full color electrophotographic image is projected with an overhead projector, the projected image shows a gray tone (i.e., graying), thereby resulting in a narrow color-tone reproduction range. The graying results from toner particles attaching to a smooth image receiving surface of the image receiving sheet and not being sufficiently embedded in the receptor layer of the image receiving sheet to be smoothed by the heat when fixing the toner. Instead, the toner particles protrude from the surface of the sheet, thereby making the surface uneven and scattering incident light during image projection. Consequently, shadows are formed on the screen.

In an exemplary technique for solving the above graying problem, Japanese Laid Open Patent Publication No. 02-263642, which is related to Japanese Patent Publication No. 2,633,023 and U.S. Pat. No. 5,032,440 (all three of which are hereby incorporated by reference) discloses the use of a resin binder having a storage elasticity modulus ranging from 100 to 10000 dye/cm$^2$ at 160° C. while having larger storage elasticity modulus than that of the toner resin at a fixing temperature of the toner. The fixing temperatures in current electrophotographic techniques, however, widely vary within a range from 140° C. to 195° C. depending on types of apparatus. Therefore, a clear projected image cannot be always obtained merely by a prescribed storage elasticity modulus at 160° C.

While many technologies for softening the receptor resin for solving the graying problem have been proposed, no technology has succeeded in preventing the graying problem. In one technique, the toner is smoothed by increasing the fixing temperature and pressure, thereby reducing light scattering. However, since the receptor layer is transferred to the fixing roller in the resin binder used in the conventional image receiving sheet, the receptor layer readily offset the fixing roller. While an oil is used during the fixing process for preventing offset of the resin for improving parting property of the roller, an excess amount of the oil not only allows image quality to deteriorate but also interferes transfer of the image receiving sheet.

The smoothing procedure as described above is useful for fixing the toner without using any oils.

SUMMARY OF THE INVENTION

Accordingly, the present invention is directed to an image receiving sheet and recording process that substantially obviates one or more of the problems due to limitations and disadvantages of the related art.

An object of the present invention is to provide an image receiving sheet and a recording process that prevents offset of the receptor layer to the fixing roller, has good color repeatability, and produces clear images without graying.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an image receiving sheet comprises a substrate having at least one face; and a receptor layer having a binder resin, the receptor layer provided on the face of the substrate, wherein the binder resin of the receptor layer has storage elasticity moduli of $10^4$ Pa or more at 130° C. and 102 Pa or more at 200° C.

In another aspect, a recording process for forming an image comprises the steps of providing an image receiving sheet, the image receiving sheet including a substrate having at least one face and a receptor layer provided on the face of the substrate such that the receptor layer has a binder resin with storage elasticity moduli of $10^4$ Pa or more at 130° C. and $10^2$ Pa or more at 200° C.; transferring toner particles onto the receptor layer to form a pattern of the toner particles corresponding to the image to be recorded on the image receiving sheet; and embedding the toner particles into the reception layer at a fixing temperature between 130° C. and 200° C. to fix the toner particles to the image receiving sheet.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DESCRIPTION OF THE PREFERRED EMBODIMENT

Reference will now be made in detail to the preferred embodiments of the present invention, examples of which are illustrated in the accompanying drawings.

The image receiving sheet according to the present invention comprises entire image receiving sheets for recording by transfer of visible images formed by toner development of electrostatic latent images, and is by no means limited to image receiving sheets for electrophotographic recording.

Figure 1:
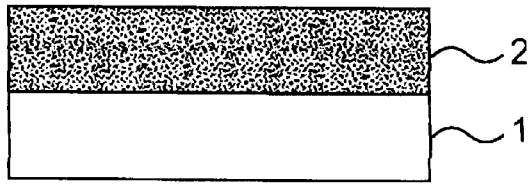
FIG. 1 is a transverse cross section of an embodiment of the image receiving sheet according to the present invention.

FIG. 1 shows a cross-sectional view showing one embodiment of the image receiving sheet according to the present invention. The image receiving sheet comprises a receptor layer 2 provided on one face of a substrate 1, resin binders comprising the receptor layer having storage elasticity moduli of $10^4$ Pa or more at 130° C. and $10^2$ Pa or more at 200° C.

Figure 2:
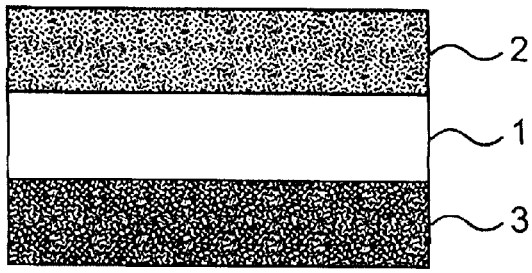
FIG. 2 is a transverse cross-sectional view of another embodiment of the image receiving sheet according to the present invention.
Figure 3:
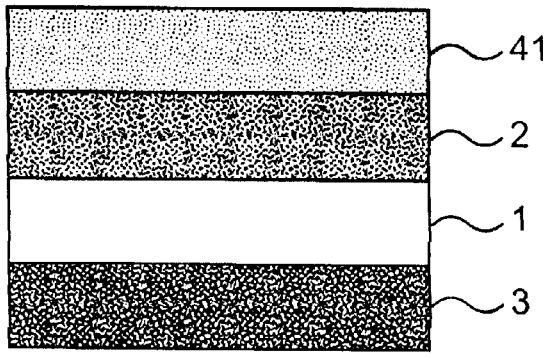
FIG. 3 is a transverse cross-sectional view of another embodiment of the image receiving sheet according to the present invention.
Figure 4:
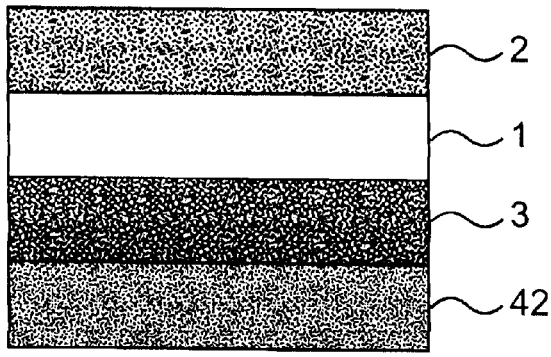
FIG. 4 is a transverse cross-sectional view of another embodiment of the image receiving sheet according to the present invention.
Figure 5:
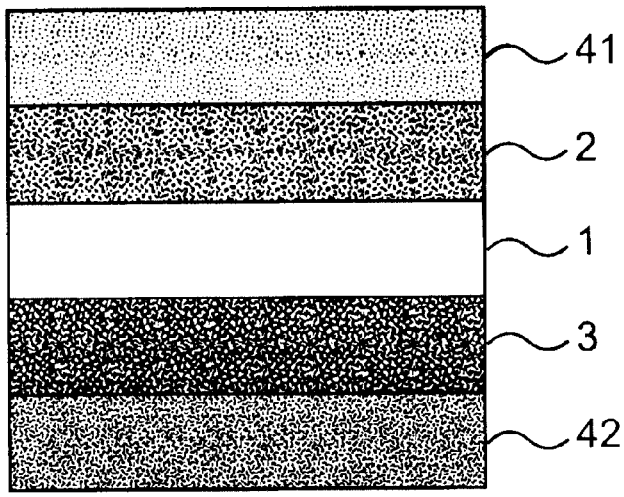
FIG. 5 is a transverse cross-sectional view of another embodiment of the image receiving sheet according to the present invention.

FIGS. 2 to 7 show vertical cross-sectional views of other embodiments of the image receiving sheet according to the present invention. In FIG. 2, the receptor layer 2 is provided on one face of the substrate 1 and a back face layer 3 having Beck smoothness of 1000 seconds or more is provided on another face of the substrate. FIG. 3 shows a configuration with the receptor layer 2 provided on one face of the substrate 1 wherein a resistance control layer 41 is provided on the receptor layer 2 and the back face layer 3 is provided on the other face of the substrate 1. FIG. 4 shows a configuration with the receptor layer 2 provided on one face of the substrate 1, wherein the back face layer 3 and a resistance control layer 42 are provided in order on the substrate 1. FIG. 5 shows a configuration with the receptor layer 2 provided on one face of the substrate 1, wherein the resistance control layer 41 is provided on the receptor layer 2 and the back face layer 2 and the resistance control layer 42 are provided in order on the substrate 1.

Figure 6:
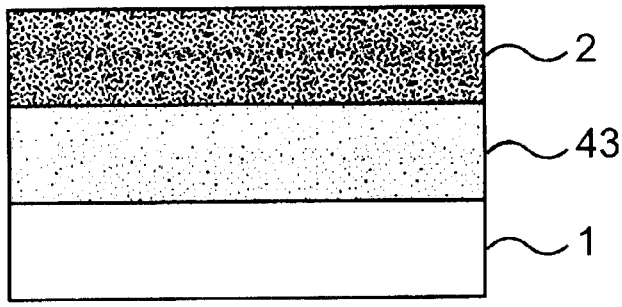
FIG. 6 is a transverse cross-sectional view of another embodiment of the image receiving sheet according to the present invention.
Figure 7:
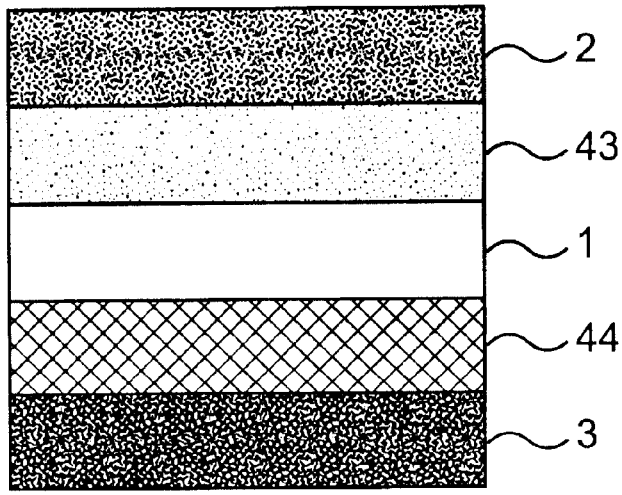
FIG. 7 is a transverse cross-sectional view of another embodiment of the image receiving sheet according to the present invention.

FIG. 6 shows a configuration with the receptor layer 2 provided on a resistance control layer 43. FIG. 7 shows a configuration with the receptor layer 2 provided on a resistance control layer 43, wherein the back face layer 2 is provided via a resistance control layer 44.

Of course, the configuration of the image receiving sheet may be varied. For example, the image receiving sheet may be provided with the resistance control layer at the outermost face of the image receiving face and/or back face, or between the receptor layer and the substrate and/or between the back face layer and the substrate, thereby being endowed with a surface electric resistance controlling function for the top and back faces of the image receiving sheet. Also, the resistance control layer may be form on either the image receiving face or on the back face of the substrate. The resistance control layer may also be provided on both faces of the substrate. Moreover, when surface electric resistivity of the back face of the substrate is not high, no resistance control layer may be provided on the back face.

The construction of each part of the image receiving sheet according to the present invention will be described below.

Substrate

A preferable substrate 1 in the image receiving sheet according to the present invention comprises thermoplastic resins to provide transparency, heat resistance, dimensional stability and rigidity when the image receiving sheet is used for observing recorded images through a transmission light as used for the overhead projector sheet. Examples of suitable thermoplastic resin sheets include films or sheets with a thickness of about 10 to 250 $\mu$m (preferably about 50 to 180 $\mu$m) made of a polyethylene terephthalate resin, a polycarbonate resin, an acrylic resin, a polyvinyl chloride resin, a polypropylene resin, a polystyrene resin, a polyethylene resin, a cellulose diacetate resin, a cellulose triacetate resin or the like. The polyethylene terephthalate resin, polyvinyl chloride resin, polypropylene resin, and cellulose triacetate resin are preferred. When the image receiving sheet according to the present invention is used for observing the recorded images through a transmission light as used for the overhead projector sheet, parallel line transmittance is preferably 70% or more in the construction of the entire image receiving sheet additionally provided with the resistance control layer and back face layer in order to obtain good transmission images.

An adhesion enhancing treatment such as a primer treatment or corona discharge treatment may be applied on the substrate 1 in order to improve adhesion between the substrate and the layers formed on the substrate.

Receptor Layer

A resin having a toner fixing ability, as well as good wettability of color toners especially for the full color electrophotographic overhead projector, is preferably used for the receptor layer to be provided on at least one face of the substrate. The resin binder has a storage elasticity modulus of $10^4$ Pa or more at 130° C. with a maximum of about $10^5$ Pa, and a storage elasticity modulus of $10^2$ or more at 200° C. to endow the resin binder with an appropriate hardness during the fixing process.

The storage elasticity modulus $G_r$ of the resin binder and the storage elasticity modulus of the toner resin $G_t$ satisfies the relation of $G_r/G_t>10$, and the relation of $G_r>G_t$ is valid at a temperature range of 130 to 200° C. presumed to be a heating temperature for fixing. Consequently, the correlation between the storage elasticity moduli of the resin binder and toner layer is so stabilized, that the toner adhered on the surface of the image receiving layer is sufficiently smoothed by the heat of fixing, enabling to reproduce highlight of the image. The storage elasticity modulus of the resin prescribed in the present invention can be measured, for example, using a Dynamic Spectrometer ARES made by Rheometrics Co. The storage elasticity moduli obtained are preferably corrected using a least-square method.

When the storage elasticity modulus $G_r$ of the resin binder and the storage elasticity modulus $G_t$ of the toner resin satisfies the relation of $G_r/G_t \leqq 10$ at 130° C., the resin binder becomes too soft such that the receptor layer is liable to offset to the fixing roller. When the relation of $G_r \leqq G_t$ is valid at a temperature range of 130 to 200° C., on the other hand, the resin binder also becomes too soft that offset of the receptor resin is readily caused.

The maximum limit of the ratio $G_r/G_t$ is about $10^4$. When the ratio $G_r/G_t$ is too large, the resin binder becomes too hard such that the toner is hardly fixed to the receptor layer, as well as arising risks that images are peeled off by finger scratches and bending.

Preferably, a resin having good compatibility with the toner is used. Examples of a resin binder comprise polyolefin resins such as polyethylene and polypropylene resins; vinyl resins such as polyvinyl chloride, polyvinylidene chloride, polyvinyl acetate, vinyl chloride-vinyl acetate copolymer, polyarcrylate and polystyrene resins; polyester resins prepared by condensation polymerization of a diol having a bisphenol frame or alkylene frame, and a divalent carboxylic acid or trivalent carboxylic acid, and a modified product thereof; polyamide resins; copolymer resins of polyolefin such as ethylene and propylene, and other vinyl monomers; ionomer resins; cellulose resins such as ethyl cellulose and cellulose acetate resins; polycarbonate resins; epoxy resins; and phenoxy resins. The phenoxy resins are mainly synthesized from epichlorohydrin and bisphenol and have no reactive epoxy group at its terminal. Specifically, the phenoxy resins may be synthesized by a 1:1 reaction of high purity bisphenol A and epichlorohydrin, or by a 1:1 reaction of high purity bisphenol A glycidyl ether and bisphenol A.

Resins having a softening temperature of 30° C. or more and 200° C. or less are used for the resins described above. The resins having softening temperatures of less than 30° C. are not preferable for storage because blocking occurs when the receptor layers adhere among the adjacent contact faces when the image receiving sheets are piled. A softening temperature exceeding 200° C. is also not preferable because a large amount of energy is required for forming (fixing) the image.

As will be described in detail hereinafter, since the polyester resins having bisphenol A frames are frequently used for the toner resin, and modified polyester resins are preferably used for the resin binder in view of their compatibility and fixing ability.

The polyester resin to be used herein, prepared using bisphenol A modified with ethylene glycol or propylene glycol, has good toner fixing ability. Although acid components of the polyester resins are not especially limited, examples of them include fumaric acid, phthalic acid, terephthalic acid, isophthalic acid, maleic acid, succinic acid, adipic acid, citraconic acid, itaconic acid, sebacic acid, malonic acid, hexacarboxylic acid and trimellitic acid.

Among the resins prepared using bisphenol A modified with propylene glycol or ethylene glycol as a diol component, and fumaric acid, maleic acid, terephthalic acid or trimellitic acid as an acid component, among the polyester resins have especially good compatibility with the toner resin, good toner fixing ability, and good toner wettability to provide a good image quality. The urethane modified polyester resin is also advantageous.

The receptor layer can also contain either an organic filler or inorganic filler, or both of them. Examples of the organic filler include fine particles comprising fluorinated resins such as tetrafluoroethylene resin and ethylene-tetrafluoroethylene copolymer, polyethylene resins, polystyrene resins, acrylic resins, polyamide resins and benzoguanamine resins. Examples of the inorganic fillers include, on the other hand, silica, colloidal silica, alumina, kaoline, clay, calcium carbonate, talc, titanium dioxide and calcium carbonate.

The mean particle size of the filler to be included is about 0.1 to 30 μm, preferably in the range of 3 to 20 μm. When the mean particle size is less than 0.1 μm, the expected effect can not be fully exhibited. When the mean particle size of over 30 μm, image defects appear or transparent feeling is decreased. The preferred content is 0.1 to 10% by weight because too large of filler content causes transparency to be decreased whereas too small of filler content compromises the effect for improving desired transfer performance.

A variety of additives such as surfactant, waxes and oils other than the fillers as described above may be used in the receptor layer in the range without preventing the effects of the present invention. The receptor layer is formed by coating the coating solution containing the resin component, filler and other required components by a printing process such as photogravure printing and screen printing, or by a coating process such as photogravure coating. The thickness of the coating film is preferably 1 to 10 μm.

Back Face Layer

The back face layer containing a filler or Si group may be provided, if necessary, on the other face of the substrate. The back face layer according to the present invention may be formed on the side of the substrate not provided with the image receiving sheet, in order to improve transfer performance and prevent the receptor layer on the top face of the substrate from being curled. When the back face layer is also provided with image receiving property as in the receptor layer on the top face of the substrate, the image can be formed on both faces of the image receiving sheet irrespective of top and back faces of the image receiving sheet.

When the back face layer is provided in the present invention, the Beck smoothness of the back face layer is adjusted to 1000 seconds or less for obtaining better transfer performance when the sheet is used for an electrophotographic copy machine or a printer. When the Beck smoothness exceeds 1000 seconds, the image receiving sheet can hardly penetrate into the fixing roller, causing poor transfer performance. The lower limit of the Beck smoothness is about 500 seconds, on the other hand, because too low smoothness results in decrease of transparency. The Beck smoothness of the image receiving sheet according to the present invention is adjusted to less than 1000 seconds on the back face layer to give some roughness to the surface. Accordingly, it is preferable to suppress decreasing tendency of transparency due to the overall construction of the image receiving sheet, by adjusting the Beck smoothness of a layer other than the back face layer, such as the receptor layer and resistance control layer formed on the image receiving sheet, to be relatively high.

The Beck smoothness is measured by the procedure prescribed in JIS P8119, which is hereby incorporated by reference, wherein a glass face having a hole at its center is placed on a test piece, 10 mL of air is blown through the hole, and the time interval (seconds) required for reducing the air pressure from 380 mmHg to 360 mmHg is measured. In other words, the Beck smoothness is defined to be the time interval required for 10 mL of air to pass through the space between the glass face and one of the sample face.

Acrylic resins, polyester resins and urethane resins, and silicone group added thermoplastic resins such as silicone modified acrylic resins, silicone modified urethane resins, and silicone modified polyester resins may be used for the back face layer. Graft copolymers having at least one parting segment among polysiloxane segments, fluorinated carbon segments and long-chain alkyl segments in the main chain of binder resins such as acrylic, vinyl, polyester, polyurethane, polyamide or cellulose resins may be used as the thermoplastic resins.

The back face layer is formed by the same coating process known in the art as used in forming the receptor layer, by adding the resin described above, an organic filler or an inorganic filler, and other additives if necessary. While a dry thickness of about 0.01 to 1.0 μm is sufficient for exhibiting sufficient effects of the back face, a corresponding thickness, preferably 0.1 to 2.0 μm, is required for controlling surface resistivity.

Examples of the resins to be used for the organic fillers in the back face layer include fluorinated resins such as tetrafluoroethylene resin and ethylene - tetrafluoroethylene copolymer resin, polyethylene resin, polystyrene resin, acrylic resin, polyamide resin and benzoguanamine resin. Silica, colloidal silica, alumina, kaoline, clay, calcium carbonate, talc, titanium dioxide and calcium carbonate are used, on the other hand, as the inorganic fillers.

Resistance Control Layer

Electrification preventive property and toner fixing ability can be advantageously maintained by providing a resistance control layer at outermost layer of the image receiving face and/or back face, or between the receptor layer and substrate and/or between the back face layer and substrate.

Resistance control materials to be used in the resistance control layer comprise ion-conductive materials, metal fine powders and conductive polymers having conjugation double bonds of π-electrons.

The ion-conductive materials include cationic, anionic and amphoteric substances comprising cationic electrification preventive materials such as quaternary ammonium salts and polyamine derivatives, anionic electrification preventive materials such as alkylphosphate, and nonionic electrification preventive materials such as fatty acid esters.

Examples of the metal fine particles include tin oxide ($SnO_2$), zinc oxide (ZnO), indium oxide ($In_2O_3$) and titanium oxide ($TiO_2$), which are used alone or in combination thereof. Such metal fine powders preferably have a mean particle size in the range of 0.01 to 1.0 μm.

Dopants may be added to the metal fine particles. Examples of the generally used dopants include Sb (antimony) for $SnO_2$, A1 (aluminum) for ZnO and Sn for $In_2O_3$. The metal oxides as described above may be used alone or in combination thereof. The metal oxides may be coated with $SnO_2$, or $SnO_2$ doped with Sb.

The metal fine particles may be needle-shaped particles having a length of their longitudinal axis within the range of 0.1 to 2 μm with an aspect ratio within the range of 10 to 50. Using such needle-shaped fine particles allow resistivity to be controlled by adding smaller amount of the needle-shaped particles than spherical particles, enabling transparency of the layers containing metal particles to be improved, besides enhancing transmission image quality when a recorded image on the image receiving sheet is observed through transmission light using an overhead projector.

$SnO_2$ or a metal oxide coated with $SnO_2$, or especially tin oxide doped with antimony, is preferably used in the image receiving sheet according to the present invention with respect to coating feasibility as metal oxides, stability of surface electric resistance, metallic electric conductivity and price.

A ratio of 0.2 to 2.0 between the mass of the metal fine particles and the mass of a thermoplastic resin is preferably used as the blending ratio of the coating solution for the layers containing the metal fine particles. When the ratio between the mass of the metal fine particle and the mass of the thermoplastic resin is less than 0.2, the surface electric resistivity of the layer is not stabilized because the content of the metal fine particle is small. When the ratio between the mass of the metal fine particle and the mass of the thermoplastic resin exceeds 2.0, on the other hand, colors unique to the metal fine particles undesirably stand out, especially when tin oxide doped with antimony is used (blue color predominantly appears on the surface when tin oxide doped with antimony is used).

It is preferred that a hydrophobic treatment is applied to the surface of the metal fine particles described above, or they are dispersed in an aqueous solution of the binder resin by adding a dispersing agent known in the art such as a surfactant or ethylene glycol.

Examples of the conductive polymer having conjugation double bonds of π-electrons include polythiophene, polyaniline, sulfonated polyaniline, chemically doped polyacetylene, polyparaphenylene, polyphenylenevinylene, polyparaphenylene sulfide, chemically polymerized and doped polypyrrole, heat-treatment products of phenol resins, heat-treatment products of polyamide, and perylene acid anhydrides. Polyaniline and polythiophene doped with a sulfonyl group are useful as a conductive polymer having conjugation double bonds of π-electrons.

Polythiophene as a electrification control agent has a structure comprising repeating units represented by formula (1):

(1)

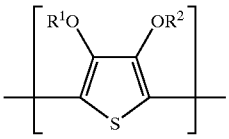

$R^1$ and $R^2$ in formula (1) independently represents hydrogen or an alkyl group with a carbon number of 1 to 4, or alkylene groups with a carbon number of 1 to 4 that may be substituted together. Examples of an alkyl group having a carbon number of 1 to 4 include a methyl group and an ethyl group. Examples of an alkylene group having a carbon number of 1 to 4 include a methyl group that may be substituted with an alkyl group; 1,2-ethylene or 1,3-propylene groups each of which may be substituted with an alkyl groups with a carbon number of 1 to 12 or with a phenyl group; 1,2-cyclohexylene group; 2,3-butylene group; 2.3-dimethyl-2,3-butylene group; and 2,3-pentylene group. A 1,2-alkylene group such as a 1,2-ethylene group can be derived from 1,2-dibromoalkane obtained by brominating a π-olefine such as ethene, prop-1-ene, hexy-1-ene, oct-1-ene, dec-1-ene and dodec-1-ene, or styrene. Methylene, 1,2-ethylene and 1,3-propylene groups are preferable among the alkylene groups, and 1,2-ethylene group is especially preferable.

Polythiophene comprising the repeating units of formula (1) forms an electron conductive polymer having conjugated double bond of π-electrons. Different from conventional ion-conductive materials, the electrification control ability is hardly changed by environmental changes, and maintains nearly constant electrification control property under varying environments. Accordingly, an image receiving sheet that is hardly affected by environmental changes, that has good toner fixing ability and excellent image quality, and that has good transfer performance in an electrophotographic copy machine or printer can be obtained by using polythiophene as a electrification control agent for the image receiving sheet.

Polythiophene has a sufficiently high transparency that it can be used for producing an image receiving sheet for the overhead projector. When the image receiving sheet especially requires high transparency, its transmittance can be adjusted to 70% or more. Carbon black cannot be used for the image receiving sheet for use in the overhead projector as using polythiophene, because carbon black has no transparency in spite of its electronic conductance or metallic conductance.

Contrary to conventional low molecular weight electrification control agents, polythiophene as a polymer hardly bleeds out of the layers containing it. Therefore, the image receiving sheet does not become sticky, electrification control ability is never decreased during storage, and the toner receptor layer is not contaminated with the electrification control agent that has been bled out (i.e., back face transfer).

Polythiophene is dissolved or dispersed in water or in a mixed solvent of water and a water-soluble organic solvent (for example, methanol, ethanol and acetone) with positive charges in the presence of polyanions. Accordingly, a layer containing polythiophene is easily formed by coating a coating solution for the electrification control layer or receptor layer on the substrate of the image receiving sheet.

Polyanion sources comprise, for example, polymeric sulfonic acids such as polystyrene sulfonic acid, polymeric carboxylic acids such as polyacrylic acid, poly-phosphoric acids or their alkali salts, especially those having a molecular weight of 2,000 to 500,000. Polystyrene sulfonic acid is a preferable polyanion.

A particle size of 10 $\mu$m or less is preferable for preparing dispersion solutions as described above. Polythiophene dispersion solutions such as, for example, Baytron P (made by Bayer Co.) are commercially available.

The coating solution for forming a layer containing polythiophene is prepared by adding polythiophene and other ingredients in water or in an aqueous solvent prepared by mixing water and an organic solvent, or by independently preparing a polythiophene solution or dispersion and a coating solution (for example a coating solution for the receptor layer), followed by mixing both solutions. When a commercially available polythiophene solution or dispersion is used, it is diluted with water, a water-soluble organic solvent or an aqueous solvent prepared by mixing water and organic solvents. Otherwise, other ingredients are added or other coating solutions are mixed to prepare a coating solution for use in forming a layer containing polythiophene.

A layer containing polythiophene is formed by coating or spraying the coating solution prepared as described above onto other layers provided on the surface of or on the substrate, followed by drying and solidifying the coated layer.

When a resistance control layer containing polythiophene is to be provided, a coating solution is coated after preparing the solution by dissolving or dispersing polythiophene in water, or in an aqueous solvent prepared by mixing water and organic solvents, in the presence of an polyanion. The amount of addition of polythiophene in the electrification control layer is usually in the range of 1 to 200 parts by weight, preferably in the range of 5 to 100 parts by weight, relative to 1 part by weight of the binder resin. The coating amount is usually in the range of 0.001 to 0.2 g/m$^2$, preferably in the range of 0.005 to 0.1 g/m$^2$, as a solid fraction.

Sulfonated polyaniline is also useful as a conductive polymer material having a conjugated structure of $\pi$-electrons. While sulfonated polyaniline refers to polyaniline doped with a sulfonyl group including a variety of compounds, one example of sulfonated polyaniline is shown in formula (2):

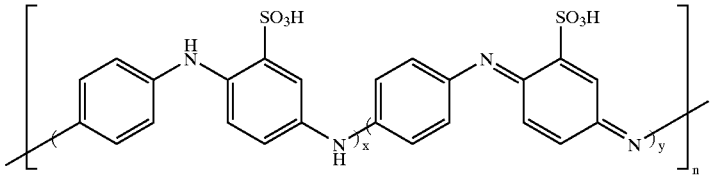

(2)

In formula (2), x, y and z are selected so that the molecular weight accounts for about 300 to 10,000.

Sulfonated polyanion described above is soluble in water or in an solvent containing an aqueous alkaline solution forming an intermolecular salt or an alkaline salt. Such sulfonated polyanion is commercially available by a trade name of Aqua Pass-01Z (made by Nitto Chemical Industry Co.) as solutions in water or in a mixed solvent of water and organic solvents, which can be also used in the present invention. While these solutions have yellowish color, they are almost colorless when their concentrations are low. Therefore, dilute solutions can be used without any problem for the applications requiring transparency of the image receiving sheet such as for observing recorded images through light transmission over the overhead projector sheet.

The composition of the coating solution for forming a layer containing sulfonated polyaniline preferably comprises about 0.5 to 40%, preferably 1.0 to 30% by weight of the binder resin; about 0.01 to 10% by weight of sulfonated polyaniline (solid fraction); about 0 to 2%, preferably 0.2 to 1% by weight of a surfactant; and a balance of the solvent. Superior electrification preventive effects are obtained by selecting the solvent composition so that the coating solution contains sulfonated polyaniline particles with a particle size of 0.01 to 1.0 $\mu$m.

Although sulfonated polyaniline is soluble in water, it is insoluble in a water-soluble organic solvent. Accordingly, sulfonated polyaniline can be dispersed to form fine particles by adjusting the mixing ratio of water and the water-soluble organic solvent in preparing the coating solution, or by adding an appropriate surfactant together depending on situations. Particle size distribution of sulfonated polyaniline in the coating solution can be changed depending on the mixing ratio between water and the organic solvents.

The coating solution containing water and IPA in a mixing ratio of, for example, 40/60 is not so preferable, since two separate particle size distributions centered at about 0.04 $\mu$m and about 5 $\mu$m appear. This is because the particles of sulfonated polyaniline having two separate particle size distributions are difficult to be uniformly dispersed in the coating solution, which can be used as a electrification control solution by coating under a specific coating condition.

The coating solution containing water and IPA in a mixing ratio of, for example, 47/53 to 60/40 is preferably used, on the contrary, since the sulfonated polyaniline particles distribute within a range of 0.01 to 1.0 $\mu$m. However, the blending ratio of a detergent requires caution because the particle size distribution of sulfonated polyaniline ascribed to the mixing ratio between water and an organic solvent is changed when a surfactant is used together with the coating solution.

The resistance control layer containing sulfonated polyaniline and a binder is formed by coating and drying the coating solution using a coating process such as a photogravure coater, roll coater and wire bar under the outermost surface (image receiving face or back face) of the image receiving sheet or receptor layer, or under the back face layer.

The coating solution is coated in an amount to form a coating thickness after drying within the range of about 0.05 to 10 μm, preferably 0.5 to 5 μm. When the coating amount is less than the range above, electrification control ability becomes insufficient. The larger amount than the above range is also not preferable since the ability is not so improved in proportion to the thickness of the layer, causing economically unfavorable besides decreasing image density in the electrophotographic copy machine and printer.

Toner

The toner to be used in forming images by electrophotography is produced by melting and kneading a binder resin, colorant and electrification control agent, followed by crushing and classification. Toners may be also produced directly by polymerization in recent years.

As described in Japanese Laid Open Patent Publication No. 5-27479, which is related to U.S. Pat. No. 5,258,255 (both of which are incorporated by reference), the toner resin comprises a polyester resin represented by formula 3 below in which bisphenol A modified with polyethylene glycol or propylene glycol is used as a diol:

(3)

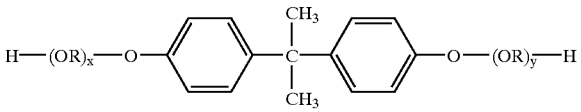

In formula (3), R denotes a ethylene group or propylene group, and x, y and z represent integers, respectively, with a mean value of x+y of 2 to 7.

Examples of the acid components to be co-condensed with the alcohol component described above include maleic acid, fumaric acid, citraconic acid, itaconic acid, phthalic acid, isophthalic acid, terephthalic acid, cyclohexane dicarboxylic acid, succinic acid, adipic acid, sebacic acid, azelaic acid and malonic acid.

As disclosed in Japanese Laid Open Patent Publication No. 5-80586, which is related to U.S. Pat. No. 5,266,432 (both of which are hereby incorporated by reference), a polyester resin prepared by co-condensation of a linear or branched polyester with a trifunctional or more of carboxylic acid and/or an alcohol is also included in the example.

The examples of the toner resin also includes styrene or styrene-acrylic resins other than polyester resins.

A variety of dyes and pigments may be used for colorants for the toner including, for example, a metal containing azo dye as a negatively electrification control agent in addition to a positive electrification control agents.

Fine particles of a polymer such as a copolymer of acrylic-vinyl monomers and fine silica particles are added to the toner in order to control electric resistance and electrification or to enhance cleaning property of the toner, and a characteristics improving agent such as a wax is added as a offset preventing agent for preparing the toner.

It is preferable in the toner binder that the storage elasticity modulus $G_t$ of the toner resin and the storage elasticity modulus $G_r$ of the resin binder satisfies the relation of $G_r/G_t>10$ at 130° C., and the relation of $G_r>G_t$ is always valid at the fixing temperature in the range of 130 to 200° C. The conditions above allows the projected image of the overhead projector to be free from graying with excellent color repeatability, enabling a clear projection image to be obtained.

The surface resistivity of the image receiving sheet according to the present invention is controlled by providing a resistance control layer at the outermost layer of the image receiving layer of the image receiving sheet and/or back face, or between the receptor layer and substrate and/or between the back face layer and substrate, while controlling the content of the resistance control agent in the resistance control layer, or by controlling the amount of coating. When metal fine particles or a resistance control agent comprising a conductive polymer having conjugated double bonds of π-electrons is used, it is preferable to adjust the surface resistivity of the image receiving sheet within a range of $10^8$ to $10^{13}$ Ω/sq at an environment of 10° C. and 30 to 80% RH, thereby limiting the rate of change of resistivity to a constant value within two figures.

The phrase "the rate of change of resistivity within two figures" as used herein refers to a relation of b/a ≦100, wherein a (Ω/sq) denotes the minimum rate of change of the surface resistivity and b (Ω/sq) denotes the maximum rate of change of the surface resistivity.

The surface electric resistivity, or area resistance, of the image receiving face and back face of the image receiving sheet can be controlled by changing conductivity of the layer containing the electrification control agent. For example, when the thickness of the resistance control layer is increased, its conductivity is increased to decrease area resistance. Conductivity of the layer having a electrification control ability can be changed depending on the conditions such as the thickness of the resistance control layer and substrate, the blending ratio between the resistance control agent and binder resin, and the mixing ratio among water, organic solvents and detergents in the coating solution.

When the surface resistivity of the image receiving sheet is lower than 108 (/sq, transfer efficiency is decreased and image recording density tends to be decreased while, when the surface resistivity exceeds $1\times10^{13}$ Ω/sq, on the contrary, discharge is generated when the image receiving sheet is peeled off from the photosensitive member after transfer of the toner to cause scattering of the toner, thereby deteriorating image quality and clearness due to disturbance of characters and pictures. Also, transfer performance becomes poor and dusts are readily adhered in the electrophotographic copy machine and printer, due to generated electrostatic charge and insufficient lubrication.

The present invention will be described in detail with reference to examples. The terms "%" and "parts" in the description are based on the mass, unless otherwise stated.

EXAMPLE 1

A receptor layer was formed on one face of the substrate described below using the receptor layer coating solution 1 described below. A resistance control layer was formed on the receptor layer using the resistance control coating solution 1 described below to prepare an image receiving sheet according to Example 1. The thickness of the receptor layer (after drying) was adjusted to 1 μm so that the surface electric resistivity of the image receiving sheet becomes 1 to $5\times10^{11}$ Ω/sq.

| Substrate |
| --- |
| Polyethylene terephthalate film with a thickness of 100 μm. |

| Receptor layer coating solution 1 | |
|---|---|
| Urethane modified polyester resin solution (storage elasticity moduli of $3 \times 10^5$ Pa and $1 \times 10^3$ Pa at 130° C. and 200° C., respectively, with a solid fraction content of 30%) | 30 parts |
| Silica filler | 0.5 parts |
| Methyethyl ketone | 50 parts |
| Toluene | 20 parts |

| Resistance control coating solution 1 | |
|---|---|
| Cation modified quaternary ammonium salt | 1 parts |
| Isopropyl alcohol | 100 parts |

EXAMPLE 2

A receptor layer was formed on one face of the substrate used in Example 1 using the receptor layer coating solution 2 described below. A resistance control layer was formed on the receptor layer using the resistance control coating solution 1 used in Example 1 to prepare an image receiving sheet according to Example 2. The thickness of the receptor layer (after drying) was adjusted to 2 μm so that the surface electric resistivity of the image receiving sheet becomes 1 to $5\times10^{11}$ Ω/sq.

| Receptor layer coating solution 2 | |
|---|---|
| Polyester resin (storage elasticity moduli of $2 \times 10^4$ Pa and $1 \times 10^2$ Pa at 130° C. and 200° C., respectively) | 20 parts |
| Polymethyl methacrylate filler (mean particle size of 3 μm) | 1 part |
| Methyethyl ketone | 40 parts |
| Toluene | 40 parts |

EXAMPLE 3

A receptor layer was formed on one face of the substrate used in Example 1 using the receptor layer coating solution 3 described below. A resistance control layer was formed on the receptor layer using the resistance control coating solution 1 used in Example 1 to prepare an image receiving sheet according to Example 3. The thickness of the receptor layer (after drying) was adjusted to 1 μm so that the surface electric resistivity of the image receiving sheet becomes 1 to $5\times10^{11}$ Ω/sq.

| Receptor layer coating solution 3 | |
|---|---|
| Phenoxy resin (storage elasticity moduli of $5 \times 10^5$ Pa and $1 \times 10^3$ Pa at 130° C. and 200° C., respectively) | 20 parts |
| Silica filler (mean particle size of 5 μm) | 0.1 part |
| Methylethyl ketone | 80 parts |

EXAMPLE 4

A back face layer was formed on the back face of the image receiving sheet prepared in Example 1 using the back face coating solution 1 described below. A resistance control layer was formed on the back face layer using the resistance control coating solution 1 used in Example 1 to prepare an image receiving sheet according to Example 4. The thickness of the receptor layer (after drying) was adjusted to 1 μm so that the surface electric resistivity of the image receiving sheet becomes 1 to $5\times10^{11}$ Ω/sq.

| Back face coating solution 1 | |
|---|---|
| Urethane modified polyester resin solution (containing 30% of solid fraction) | 30 parts |
| Silica filler (mean particle size of 5 μm) | 0.1 part |
| Methylethyl ketone | 50 parts |
| Toluene | 20 parts |

EXAMPLE 5

A resistance control layer was formed on one face of the substrate used in Example 1 using the resistance control coating solution 2 described below. A receptor layer was formed on the resistance control layer using the receptor layer coating solution used in Example 1. A resistance control layer was also formed on the other face of the substrate using the resistance control coating solution 2. A back face layer was formed on the resistance control layer using the back face coating solution used in Example 4 to prepare an image receiving sheet 5 according to Example 5. The thickness of the receptor layer (after drying) and the thickness of the back face layer were adjusted to 1 μm, respectively, the thickness of the resistance control layer being adjusted so that the surface electric resistivity of the image receiving sheet becomes 1 to $5\times10^{11}$ Ω/sq.

| Resistance control layer coating solution 2 | |
|---|---|
| Aqueous dispersion solution of needle-shaped tin oxide (length of longitudinal axis; 0.5 μm, aspect ratio; 10 to 20, solid fraction; 20%) | 30 parts |
| Polyester resin emulsion (glass transition pint; 60° C., solid fraction; 30%) | 30 parts |
| Isopropyl alcohol | 20 parts |
| Water | 20 parts |

EXAMPLE 6

A resistance control layer was formed on one face of the substrate used in Example 1 using the resistance control layer coating solution 3 described below. A receptor layer was formed on the resistance control layer using the receptor layer coating solution 1 used in Example 1 to prepare an image receiving layer according to Example 6. The thickness of the receptor layer (after drying) was adjusted to 1 μm, and the thickness of the resistance control layer being adjusted so that the surface electric resistivity of the image receiving sheet becomes 1 to $5\times10^{11}$ Ω/sq.

| Resistance control layer coating solution 3 | |
|---|---|
| Aqueous solution of polyester resin (terephthalic acid-diethylene glycol copolymer, glass transition point 40° C., solid fraction 30%) | 10 parts |

-continued

| Resistance control layer coating solution 3 | |
|---|---|
| Aqueous polythiophene solution (Baytron P, made by Bayer Co., solid fraction 1%) | 50 parts |
| Isopropyl alcohol | 20 parts |
| Water | 20 parts |

EXAMPLE 7

A resistance control layer was formed on one face of the substrate used in Example 1 using the resistance control layer coating solution 4 described below. A receptor layer was formed on the resistance control layer using the receptor layer coating solution 1 used in Example 1 to prepare an image receiving layer according to Example 7. The thickness of the receptor layer (after drying) was adjusted to 1 μm, and the thickness of the resistance control layer was adjusted so that the surface electric resistivity of the image receiving sheet becomes 1 to $5\times10^{11}$ Ω/sq.

| Resistance control layer coating solution 4 | |
|---|---|
| Sulfonated polyaniline (SAVE-01Z made by Nitto Chemical Industry Co., solid fraction 1%) | 1 parts |
| Aqueous polyester resin solution (Polyester WR-961 made by Nihon Synthetic Chemicals Co., solid fraction 30%) | 5 parts |
| Isopropyl alcohol | 47 parts |
| Water | 47 parts |

COMPARATIVE EXAMPLE 1

A receptor layer was formed on one face of the substrate used in Example 1 using the receptor layer coating solution 4 described below. A resistance control layer was formed on the receptor layer using the resistance control layer coating solution 1 used in Example 1 to prepare an image receiving layer according to Comparative Example 1. The thickness of the receptor layer (after drying) was adjusted to 2 μm, and the thickness of the resistance control layer was adjusted so that the surface electric resistivity of the image receiving sheet becomes 1 to $5\times10^{11}$ Ω/sq.

| Receptor layer coating solution 4 | |
|---|---|
| Polyester resin (a polymer of fumaric acid and bisphenol A modified with propylene glycol, storage elasticity moduli at 130° C. and 200° C. of $8\times10^2$ Pa and $1\times10^2$ Pa, respectively) | 30 parts |
| Silica fine particles (mean particle size 5 μm) | 0.3 parts |
| Methyethyl ketone | 35 parts |
| Toluene | 35 parts |

Image quality, transfer performance and the Beck smoothness of the receptor layer were evaluated using the image receiving sheets in Examples and Comparative Example.

Evaluation Method

The surface electric resistivity of the image receiving sheet in each Examples 1–7 and Comparative Example 1 was measured 10 seconds after applying a voltage of 500 V on the surface of each sheet under an environment of 23° C. and 50% RH using a surface resistance measuring apparatus (Hiesta, made by Mitsubishi Oil Chemicals Co.).

To evaluate image quality, a color chart image was formed on each image receiving sheet using an electrophotographic fall color printer. Projected images of the image receiving sheet with an overhead projector were evaluated with respect to graying and color tone repeatability.

A commercially available color laser printer re-modeled to enable monitoring of the roll surface temperature. The two kinds of the toners were used. In the first toner (Toner A1), the binder resin was composed of a polyester resin having fumaric acid and bisphenol A modified with propylene glycol. The toner resin had a storage elasticity moduli of $1\times10^3$ Pa and $1\times10^1$ Pa at 130° C. and 200° C., respectively.

In the second toner (Toner A2), the binder resin was composed of a polyester resin comprising terephthalic acid and bisphenol A modified with propylene glycol. The toner resin had storage elasticity moduli of $2\times10^3$ Pa and $1.5\times10^2$ Pa at 130° C. and 200° C., respective The surface temperature of the fixing roll of the printer was adjusted to 150° C. and 190° C. when the toner A1 and toner A2 were used, respectively. The printing line pressure was adjusted to 10 kg/width of A4 size paper. Silicone oil of 2 mg/A4 size paper were fed to the surface of the fixing roll. The recording speed was 3 ppm with a printing tone of 5% over 0 to 100% printing density.

The ratio of $G_r/G_t$ was calculated from the storage elasticity modulus ($G_t$) of the toner resin and storage elasticity modulus ($G_r$) of the resin binder in the temperature range of 130 to 200° C., with the image receiving sheets of Examples 1–7 and Comparative Example 1 used for recording by electrophotography, obtaining the results in Table 1 below. The ratio of $G_r/G_t$ in the table below was calculated from the storage elasticity modulus of each toner at 130° C.

TABLE 1

Storage Elasticity Modulus

| | Storage elasticity modulus of resin binder (Pa) | | $G_r/G_t$ | |
|---|---|---|---|---|
| | 130° C. | 200° C. | 130° C. | Kind of Toner |
| Example 1 | $3\times10^5$ | $1\times10^3$ | 150 | Toner $A_2$ |
| Example 2 | $2\times10^4$ | $1\times10^2$ | 20 | Toner $A_1$ |
| Example 3 | $5\times10^5$ | $3\times10^3$ | 250 | Toner $A_2$ |
| Example 4 | $3\times10^5$ | $1\times10^2$ | 150 | Toner $A_2$ |
| Example 5 | $3\times10^5$ | $1\times10^3$ | 150 | Toner $A_2$ |
| Example 6 | $3\times10^5$ | $1\times10^3$ | 150 | Toner $A_2$ |
| Example 7 | $3\times10^5$ | $1\times10^3$ | 150 | Toner $A_2$ |
| Comparative Example 1 | $8\times10^2$ | $1\times10^2$ | 0.8 | Toner $A_1$ |

Evaluation criteria of the image quality were as follows:

○: No graying is observed at a yellow highlighted portion, and a clear projection image is obtained with good color tone repeatability.

Δ: A slight graying is observed at a yellow highlighted portion, and an almost clear projection image is obtained with rather good color tone repeatability.

x: Graying is obviously observed at a yellow highlighted portion, and the projection image is blurred with poor color tone repeatability.

To evaluate transfer performance, fifty sheets each of the image receiving sheets were prepared with respect to Examples 1–7 and Comparative Example 1 to investigate pick-up feasibility (or the jam frequency in the fifty sheets) when the sheets are fed to the printer using a cassette. The Beck smoothness with respect to the receptor face of each image receiving sheet in Examples 1–7 and Comparative Example 1 was investigated according to the method prescribed in JIS P8199.

The results of evaluation in Examples and Comparative Example 1 are listed in Table 2.

TABLE 2

Performance Evaluation Results

| | Image Quality | Transfer Performance | Beck Smoothness (sec.) | Note |
|---|---|---|---|---|
| Example 1 | ○ | 0/50 | 200 | |
| Example 2 | ○ | 0/50 | 70 | |
| Example 3 | ○ | 0/50 | 800 | |
| Example 4 | ○ | 0/50 | 200 | No oil was used for fixing. |
| Example 5 | ○ | 0/50 | 200 | |
| Example 6 | ○ | 0/50 | 200 | |
| Example 7 | ○ | 0/50 | 200 | |
| Comparative Example 1 | x | 4/50 | 2500 | Receptor layer offsets to fixing roller. |

In accordance with the present invention, receptor layers are provided at least one face of the substrate in the image receiving sheet such that the binder resin of the receptor layer has a storage elasticity modulus of $10^4$ Pa or more and $10^2$ Pa or more at 130° C. and 200° C., respectively, in order to prevent offset of the receptor layer to the fixing roller. The storage elasticity modulus $G_r$ of the resin binder and the storage elasticity modulus $G_t$ of the toner resin satisfies the relation of $G_r/G_t > 10$ at 130° C. as well as the relation of $G_r > G_t$ at a fixing temperature between 130° C. and 200° C. Therefore, the toner is smoothed by itself to hardly causes graying in the projected image from an overhead projector. Preferably, a back face layer is provided on a face of the substrate opposite the receptor layer, and at least one of the back face layer and receptor layer has Beck smoothness of 100 seconds or less, in order to improve transfer performance in the printer.

Electrification preventive property and toner fixing ability can be advantageously maintained in the present invention by providing a resistance control layer on the outermost layer of the image receiving layer and/or back face layer, or by providing a resistance control layer between the receptor layer and substrate and/or between the back face layer and substrate. Ion-conduction materials, metal fine particles, or conductive polymers having conjugated double bonds of π-electrons are used for the resistance control material of the resistance control layer. Therefore, the coated face does not become sticky, and the electrification control agent is not transferred between contact faces. Thus, surface resistivity changes are prevented during storage of the image receiving sheet. A resistance control layer may be provided at the outermost layer of the image receiving layer and/or back face, or between the receptor layer and substrate and/or between the back face layer and substrate, thereby allowing electrification preventive property and toner fixing ability to be favorably maintained. A resistance control substance comprising an ion-conductive resistance control substance, metal fine particles or a conductive polymer having conjugated double bonds of π-electrons are used in the resistance control layer in the present invention, thereby coating faces are prevented from being sticky and the resistance control substance does not transfer to contact faces to change the surface resistivity.

It will be apparent to those skilled in the art that various modifications and variations can be made in the image receiving sheet and recording process of the present invention without departing from the spirit or scope of the invention. Thus, it is intended that the present invention cover the modifications and variations of this invention provided they come within the scope of the appended claims and their equivalents.

What is claimed is:

1. An image receiving sheet, comprising:

a substrate having at least one face;

a receptor layer having a binder resin, the receptor layer provided on the face of the substrate, wherein the binder resin of the receptor layer has storage elasticity moduli of $10^4$ Pa or more at 130° C. and $10^2$ Pa or more at 200° C.; and a back face layer provided on a back face of said substrate opposite the face, at least one of the back face layer and the receptor layer having Beck smoothness of 1000 seconds or less, wherein the storage elasticity modulus $G_r$ of the binder resin of said receptor layer and the storage elasticity modulus $G_t$ of a toner resin satisfies a relation of $G_r/G_t > 10$ at 130° C. and satisfies a relation of $G_r > G_t$ in an entire temperature range of 130 to 200° C.

2. The image receiving sheet according to claim 1, further comprising a resistance control layer provided on one of the receptor layer and the back face layer.

3. The image receiving sheet according to claim 2, wherein the resistance control layer includes an ion-conductive resistance control material.

4. The image receiving sheet according to claim 2, wherein the resistance control layer includes a resistance control material comprising metal fine particles.

5. The image receiving sheet according to claim 2, wherein the resistance control layer includes a resistance control substance comprising a conductive polymer having conjugated double bonds of π-electrons.

6. The image receiving sheet according to claim 1, further comprising a resistance control layer provided between the substrate and one of the receptor layer and the back face layer and substrate.

7. The image receiving sheet according to claim 6, wherein the resistance control layer includes an ion-conductive resistance control material.

8. The image receiving sheet according to claim 6, wherein the resistance control layer includes a resistance control material comprising metal fine particles.

9. The image receiving sheet according to claim 6, wherein the resistance control layer includes a resistance control substance comprising a conductive polymer having conjugated double bonds of π-electrons.

10. The image receiving sheet according to claim 1, wherein the image receiving sheet has a parallel line transmittance of 70% or more.

11. An image receiving sheet, comprising:

a substrate having at least one face;

a receptor layer having a binder resin, the receptor layer provided on the face of the substrate, wherein the binder resin of the receptor layer has storage elasticity moduli of $10^4$ Pa or more at 130° C. and $10^2$ Pa or more at 200° C.; and a back face layer provided on a back face of said substrate opposite the face, at least one of the back face layer and the receptor layer having Beck smoothness of 1000 seconds or less.

12. The image receiving sheet according to claim 11, further comprising a resistance control layer provided on one of the receptor layer and the back face layer.

13. The image receiving sheet according to claim 11, further comprising a resistance control layer provided between the substrate and one of the receptor layer and the back face layer and substrate.

14. The image receiving sheet according to claim 11, wherein the image receiving sheet has a parallel line transmittance of 70% or more.

15. A recording process for forming an image, comprising the steps of:

providing an image receiving sheet, image receiving sheet including a substrate having at least one face and a receptor layer provided on the face of the substrate such that the receptor layer has a binder resin with storage elasticity moduli of $10^4$ Pa or more at 130° C. and $10^2$ Pa or more at 200° C.;

transferring toner particles onto the receptor layer to form a pattern of the toner particles corresponding to the image to be recorded on the image receiving sheet; and embedding the toner particles into the reception layer at a fixing temperature between 130° C. and 200° C. to fix the toner particles to the image receiving sheet, wherein the image receiving sheet further comprises a back face layer provided on a back face of said substrate opposite the face, at least one of the back face layer and the receptor layer having Beck smoothness of 1000 seconds or less.

16. The recording process according to claim 15, wherein no oil is used during the process for fixing the toner.

17. The recording process according to claim 15, wherein the storage elasticity modulus $G_r$ of the binder resin of said receptor layer and the storage elasticity modulus $G_t$ of a toner resin satisfies a relation of $G_r/G_t>10$ at 130° C. and satisfies a relation of $G_r>G_t$ in an entire temperature range of 130 to 200° C.

* * * * *